US006086745A

United States Patent [19]

Tsirelnikov

[11] Patent Number: 6,086,745

[45] Date of Patent: Jul. 11, 2000

[54] ALLOTROPIC MODIFICATION OF ZIRCONIUM AND HAFNIUM METALS AND METHOD OF PREPARING SAME

[76] Inventor: Viatcheslav I. Tsirelnikov, 117-A Beaufort La., Columbus, Ohio 43214

[21] Appl. No.: 08/887,838

[22] Filed: Jul. 3, 1997

[51] Int. Cl.[7] ..... C25C 3/26

[52] U.S. Cl. ..... 205/397

[58] Field of Search ..... 205/705, 366, 205/397, 411

[56] References Cited

U.S. PATENT DOCUMENTS

| | | | |
|---|---|---|---|
| 2,734,856 | 2/1956 | Schultz et al. | 204/64 |
| 2,864,749 | 12/1958 | Slatin | 204/64 |
| 2,941,931 | 6/1960 | Dean | 204/61 |
| 3,444,058 | 5/1969 | Mellors et al. | 204/71 |
| 3,498,894 | 3/1970 | Cuomo et al. | 205/366 |
| 4,588,485 | 5/1986 | Cohen et al. | 204/64 |
| 4,686,025 | 8/1987 | Cohen et al. | 204/245 |
| 4,923,579 | 5/1990 | Snyder et al. | 205/397 |

FOREIGN PATENT DOCUMENTS

| | | | |
|---|---|---|---|
| 598358 | 5/1960 | Canada | 205/71 |
| 685774 | 5/1964 | Canada . | |

OTHER PUBLICATIONS

S.I.Troyanov, V.I.Tsirelnikov, Zirconium, monochloride, Russ.J.Inorg.Chem., vol. 15, No. 12, p. 1762, Dec. 1970.

S.I.Troyanov, Structure of zirconium monochloride, Russ.J.Inorg.Chem., vol. 28, No. 3, pp. 89–91, Mar. 1973.

D.G.Adolfson, J.D.Corbett, Crystal structure of zirconium monochloride. A novel phase containing metal–metal bonded sheets, Inorg.Chem., vol. 15, pp. 1820–1823, Jan. 1977.

S.I.Troyanov et al. The thermogravimetric determination of heats of formation of lower halides of zirconium, Izv.Sib.Otd.Acad.Sci., USSR, Chem., Chem.Techn., vol. 4, No. 9, pp. 116–119, Sep. 1974.

M. A. Steinberg et al's Extractive Metallurgy of Zirconium by the Electrolysis of FusedSalts, Journal of the Electrochem.,Soc., vol. 101, No. 2, pp. 137–144, Feb. 1954.

M.V.Smirnov et al., Cathodic process during deposition of zirconium from chloride melts, Russ.J.Phys.Chem., vol. 37, No. 8, pp. 901–905, Aug. 1963.

C.M.Craighead et al., Nature of the markings in Titanium and alfa Titanium Alloys, J.Metals, vol. 4 No. 12, pp. 1317–1319, Dec. 1952.

H.S.Marek et al., Crystal structure and thermodynamic characteristics of zirconium and hafnium monobromides, Russ. J Inorg.Chem., vol. 24, No. 4, pp. 890–893, Sep. 1979.

A.S.Izmailovich et al. Lower chlorides of hafnium, Russ.J.Inorg.Chem., vol. 24, No. 9. pp. 1309–1312, Sep. 1979.

Raynes et al The Extractive Metallurgy of Zirconium Metal: III. Expanded Scale Process Development of the Electrolytic Production of Zirconium from K2zrF6., Journal of The Electrochemical Society, vol. 102, No. 2, pp. 137–144, Mar. 1955.

(List continued on next page.)

*Primary Examiner*—Kathryn Gorgos
*Assistant Examiner*—Erica Smith-Hicks

[57] ABSTRACT

A method of obtaining a new allotropic modification of metal zirconium and hafnium with layered structure consisting of double layered disposition of metal atoms with decreased interatomic distances in the doubled layers and increased interatomic distances between doubled layers in comparison with usual hexagonal close packed α-form of metal zirconium or hafnium is presented. The metal zirconium and hafnium with such a crystal structure are obtained by an electrochemical reduction process of solid zirconium monochloride or hafnium monochloride which serves as a cathode at a temperature about 450° C. (830° F.) in molten inorganic electrolyte consisting of lithium chloride and chlorides of alkali and alkaline earth metals in the presence of an inert anode, or metal zirconium or hafnium anode. X-ray analysis results of an obtained polymorphic modification of metal zirconium and resulting density are presented.

5 Claims, 1 Drawing Sheet

*a)* *b)* *c)*

OTHER PUBLICATIONS

Miller, Zirconium, TN799, Z5M5, pp. 58–61, and 99–108, No Month Available 1954.

Department of Commerce, US Bureau of Mines, Information Circular 6456, Zirconium Part I, Jun. 1931.

Department of Commerce, US Bureau of Mines, Information Circular 6456, Zirconium Part II, Jun. 1931.

M. A. Steinberg et al's Extractive Metallurgy of Zirconium by the Electrolysis of Fused Salts, Journal of the Electrochemical Society, vol. 101, No. 2, pp. 63–78, Feb. 1954.

ALLOTROPIC MODIFICATION OF ZIRCONIUM AND HAFNIUM METALS AND METHOD OF PREPARING SAME

FIELD OF THE INVENTION

This invention relates to the processing of new materials and more particularly, new allotropic modification of zirconium and hafnium metals. It is a well known fact that many chemical elements can exist in different allotropic forms, but only one of them is thermodynamically stable at standard conditions. Nevertheless often the compounds in thermodynamically unstable allotropic modifications can exist in normal conditions indefinitely long because of the extremely low rate of conversion to stable form in named conditions. Well known examples of these existing unstable allotropic modifications are diamond, white phosphorus, gray tin, etc. Said new allotropic form of metal zirconium and hafnium is obtained from specific compounds named zirconium and hafnium monohalides. Said zirconium and hafnium monohalides have a layered structure which consists of double layers of metal atoms and double layers of halogen atoms (S. Troyanov, V. Tsirelnikov, *Russ.J.Inorg.Chem.,* 15, 1174 (1970); S. Troyanov, *Vest.Moscow Univ., Chem.,* 28, 369 (1973); D.Adolfson, J.Corbett, *Inorg. Chem.,* 15, No. 8, 1820 (1973) (see FIG. 1, *a*). These strong chemical bonds lead to decreasing of Zr—Zr or Hf—Hf interatomic distances in the layer. One example of this is in the case of zirconium monochloride whose 3.18 A atomic distance in usual α-form with close-packed hexagonal crystal structure, decreases to an atomic distance of 2.87 A. The existence of additional chemical bonds between metal atoms in the solid zirconium monociloride leads also to increased thermodynamic stability of this compound in comparison with zirconium tri- and dichlorides. Thus the temperature of their thermal decomposition at atmospheric pressure are:

for zirconium trichloride 505° C.

for zirconium dichloride 620° C.

for zirconium monochloride 900° C.

(S. Troyanov, V. Tsirelnikov, H. Marek, *Izv. Russ. Akad. Nauk, Sib. Otd., Khim . . . ,* 4(9), 111–114 (1974). This specific zirconium monohalide crystalline structure leads to anisotropy of electroconductivity of the single crystal: in directions of the layers the crystal has metallic electroconductivity, in perpendicular directions it is an insulator (S. Troyanov, *Vest. Moscow Univ. , Chem. ,* 28, 369 (1973). Thus one can say that at the same time the single crystal of zirconium monochloride is both a metallic conductor and insulator. However the powdered form of this compound is electroconductive (about 40 $\Omega^{-1}$ $cm^{-1}$) (S. Troyanov, V. Tsirelnikov, *Russ. J. Inorg. Chem. ,* 15, 1174 (1970). Weak Van der Waals bonds exist between the halogen atoms in these compounds that lead to easy displacement of "slabs" <Hal-Me-Me-Hal> in respect to one another. The new allotropic modification of metal zirconium is obtained by removing the halogen atoms from the solid crystalline zirconium monohalides by an electrochemical reduction process without distorting the metal atoms double layers sublattice. To achieve this, the reduction process is carried out at relatively low temperature so that vibration amplitudes of metal atoms in the crystal lattice are not large enough to destroy the metal atoms sublattice of the zirconium monohalide. This process is rather an electrochemical deintercalation, i. e. removing atoms from interlayer space of layered compounds without distorting the crystal lattice of compounds. The reduction process at these conditions allows for the production of a new allotropic modification of metal zirconium and hafnium consisting of double layered disposition of metal atoms with decreased distance between close-packed metal atoms in the doubled layers and an increased distance between the atoms in one double layer and the metal atoms in the other double layer (see FIG. 1, *b*).

BACKGROUND OF THE INVENTION

The usually stable at standard conditions crystalline form of metal zirconium and hafnium is of close-packed hexagonal form with a crystal structure as shown in FIG. 1, *c*). All distances between atoms are equal. At a temperature of 862° C. (1584° F. ) for zirconium and about 1800° C. (3300° F. ) for hafnium the hexagonal crystal form converts to the cubic body centered close-packed form. Since the close-packed structure is isotropic, it means that the physical properties (such as electroconductivity, thermal conductivity, etc. ) of all metals with close-packed crystal structure monocrystal are equal in all directions. It is necessary to say that zirconium and hafnium, as other refractory transition metals, usually are obtained by high temperature reduction of their compounds (halides, oxides or complex halides) where the metal is in a higher state of oxidation. The high temperature of the processes leads to obtaining of the metals in the close-packed crystal modifications which are stable at this temperature and which transform to the close-packed hexagonal structure at cooling.

The electrochemical methods for obtaining refractory transition metals (such as Ti, Zr, Hf) by electrolysis from molten salt baths are very well developed and are usually high temperature methods (over 800° C. =1470° F. ) (U. S. Pat. No. 2,864,749 and U. S. Pat. No. 3,444,050). It was established that the optimal temperature for production of zirconium by molten salts electrolysis is 800–860° C. (M. Steinberg et al. , *J. Electrochem. Soc. ,* 101, 78 (1954). Those skilled in the art know that it is possible to produce the deposit of a metal by introducing one of its derivatives, such as metal halide into a molten salt bath and by subjecting it, in its simplest principle, to the action of a potential of two electrodes linked to the poles of a source of direct current: halogen is released at the anode and the metal is deposited on the cathode. It was shown that the process of electrochemical reduction of polyvalent metals, such as zirconium, is achieved via formation of lower metal halides which however are dissolved in the melt and do not form solid crystalline phases during the process (M. Smirov et al. , *Russ. J. Phys. Chem. ,* 37, 901 (1958); U. S. Pat. No. 4,588,485 to Cohen).

A method of producing metal titanium (the metal of the same group as zirconium) obtained by electrolytic reduction of lower chlorides of titanium (dichloride and trichloride) as initial compounds which could be put into operation was described in U. S. Pat. Nos. 2,734,856 and 2,864,749 4,686,025, but said lower chlorides were dissolved in a melt. The X-ray and metallographic analyses of metals (Ti, Zr, Hf) obtained by electrolysis of molten electrolytes show that the metal is always formed in close-packed hexagonal form (α-form) and it does not included other phases except small quantity of metal hydride (M. Steinberg et al. , *J. Electrochem. Soc. ,* 101 63–78, (1954); C. Graighead et al. , *J. Metals,* 4, 1317, (1952).

However, in all these cases the deposited metal is in a close-packed form—a well known usual modification (for example, for zirconium it is α-modification).

The essence of my invention is that it has now been found that new allotropic modifications of metal zirconium and hafnium unknown before can be obtained by electrochemical reduction of the solid zirconium or hafnium monochlorides and monobromides in their solid crystalline form without dissolving it in the melt. More specifically this process of reduction is the process of electrochemical reduction (electrolysis) in molten inorganic electrolyte consisting of lithium chloride and chlorides of alkali and alkaline earth metals at the temperature of about 450° C. (830° F. ) with an inert anode and a cathode from solid crystalline zirconium monohalide in a basket from an inert metal, such as nickel with electrical contact between the cathode and zirconium monohalide. The basket consists of a lattice, the mesh of which has dimensions, such that it prevents the easy passage of particles of initial solid zirconium or hafnium monohalide and the formed metal without causing clogging.

As a result of such a reduction processes of solid crystalline zirconium or hafnium monohalide, the obtained metal zirconium or hafnium has a novel type of crystal structure unknown before for these metals. The allotropic modification has a crystal structure consisting of doubled layers of metal atoms with decreased distance between close-packed metal atoms in the doubled layers and an increased distance between the atoms in one double layer and the metal atoms in the other double layer which differs in comparison with the usual α-form of these metals. This new allotropic modification of metal zirconium and hafnium has different chemical and physical properties than usual α-zirconium and α-hafnium especially in respect to their density, hardness, catalytic activity, hydrogen adsorption, thermoplastic properties and electroconductivity. It is not surprising, since in accordance to a well known empirical rule: the layered allotropic modification of the same element usually has much higher electroconductivity than the close packed modification. Carbon serves as a good example. Its close packed modification (diamond) is an insulator, and its layered modification (graphite) is a metallic electroconductor. These properties of obtained new allotropic modification of metal zirconium and hafnium may be used for many useful applications: for catalyzing of oxidation/reduction processes with gaseous hydrogen participation, for hydrogen storage, for industrial items fabrication from metal zirconium and hafnium by powder pressing or by process of extrusion, etc.

SUMMARY OF THE INVENTION

An object of the present invention is to provide a method of preparing a new material and more particularly, a new allotropic modification of metal zirconium and hafnium with layered structure consisting of double layers of atoms with decreased interatomic distances in the doubled layers and increased interatomic distances between doubled layers in comparison with the usual close packed hexagonal α-form of metal zirconium or hafnium. The metal zirconium and hafnium with such crystal structure is obtained by the electrochemical reduction process, means electrolysis, of solid crystalline zirconium or hafnium monochloride and monobromide, which have layered crystal structure consisting of doubled layers of metal atoms and doubled layers of halogen atoms. This zirconium or hafnium monochloride serves as cathode because they are electroconductive. It is possible to obtaine zirconium or hafnium monocloride directly in an electrochemical cell by the reaction of α-zirconium or hafnium placed in the cathode-basket or electrodeposited on an inert cathode with their tetrachloride dissolved in the molten salt electrolyte. (Here and below "inert" means elctroconductive material stable in molten salt electrolyte such as nickel, molybdenum, stainless steel, or graphyte). (U. S. Pat. No. 2,941,931). The process of electrolysis is carried out at temperature about 400° C. (750° F. ) from molten inorganic electrolyte consisting of lithium chloride and chlorides of alkali and alkaline earth metals with inert anode. In the process of electrochemical reduction of solid zirconium monochloride halogen atoms are removed without distorting the metal atoms doubled layers crystal sublattice. This process is rather the electrochemical deintercalation, e. g. removing atoms from interlayer space of layered compounds without distorting the layered crystal structure of these compounds. The use of the electrochemical method of this invention, for producing the new polymorphic modification of metal zirconium and hafnium by operating with solid crystalline zirconium or hafnium monohalide thermodynamically stable at the temperature of the operation has never been proposed before: thus obtaining of the metals conserving the metal atoms layered substructure of the initial compound has never been possible in the past.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. The following embodiments are presented on an example of zirconium and hafnium monochloride, but the zirconium monobromide (H. Marek et al. , *Russ. J. Inorg. Chem.* , 24, 496 (1979) and hafnium monochloride (A. Izmailovich et al. , *Russ. J. Inorg. Chem.* , 24, 1309 (1979) have the same type of crystal structure and have chemical and thermodynamic properties similar to zirconium monochloride. Thus the proposed method of obtaining of the new allotropic modification of metal zirconium and hafnium is fully applied to these monohalides.

The entire disclosures of all applications, patents, and publications, cited above and below, are hereby incorporated by reference.

EXAMPLES

Example 1

Figure 1:
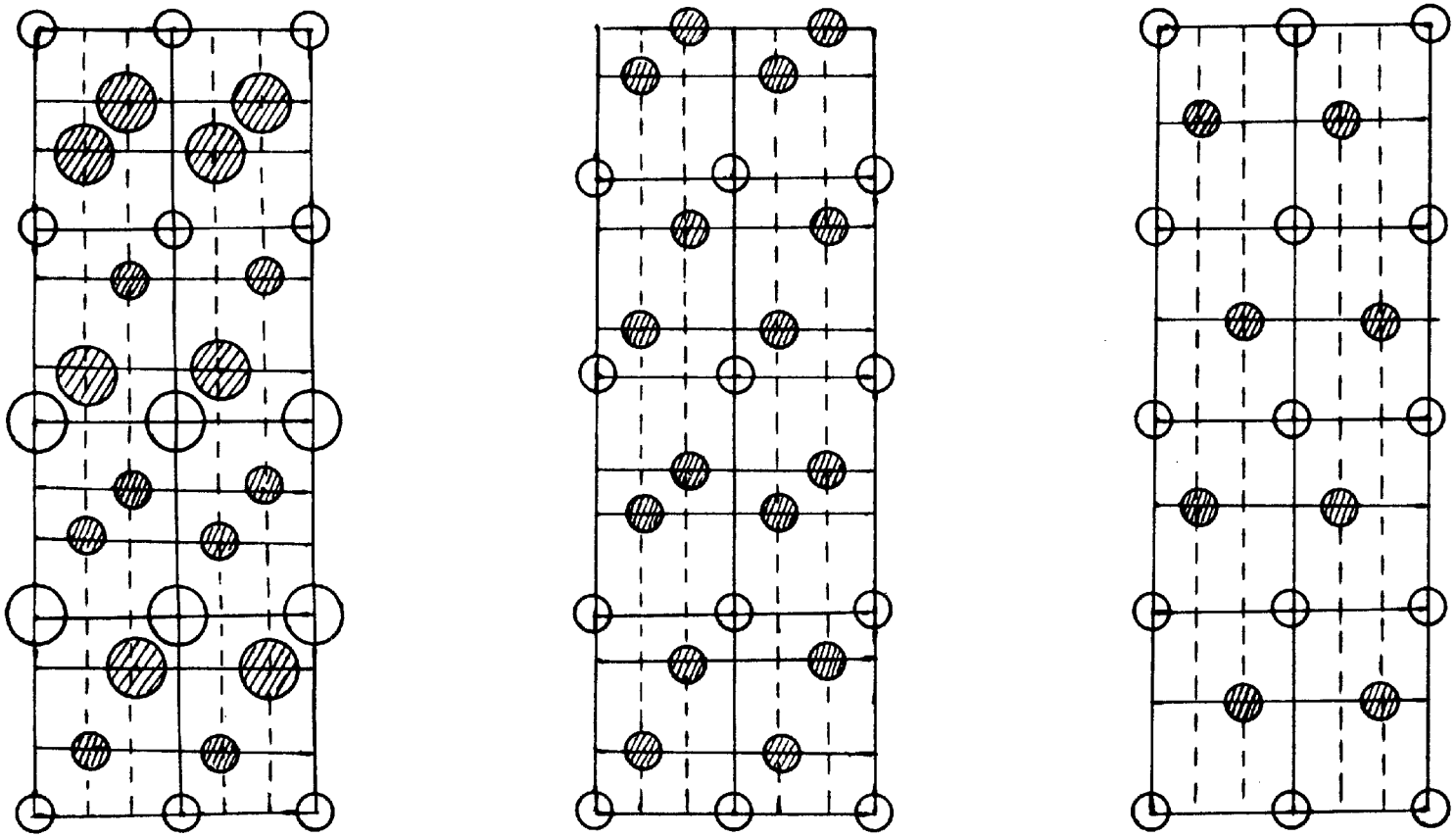
FIGS. 1A–C. A scheme showing the crystal structure of zirconium monochloride, new allotropic modification of zirconium and α-zirconium as a projection of the crystal cell atoms on the XZ plane ○- zirconium atoms ◯- chlorine atoms Shadded circles are atoms situated on ±⅓ of crystal cell parameter from XZ plane a) zirconium monochloride b) new allotropic modification of zirconium c) α-zirconium

One of the methods consists in electrolyzing a melt of 20–25% LiCl, 24–28% KCl and 50–53% $SrCl_2$ (wt. ) using a solid zirconium monochloride, in an annular basket from nickel as cathode and an anode from graphite rod. The basket consists of metal lattice of nickel, the mesh of which has dimensions such that it prevents easy passage of particles of initial solid zirconium monochloride and formed metal zirconium without clogging. The cell is a cylindrical one of stainless steel provided with an inert atmosphere, an outlet for chlorine evolution, and means for separating the basket cathode from the molten salt without exposure to air. The temperature is about 830° F. The current density on the cathode is about 200 amperes per square foot. As a result of the electrolysis the solid zirconium monochloride in the basket is converted to a flaky compound that is metal zirconium in the new crystalline double layered modification. Washing with dilute acid and drying provided a composition of pure metal in a powder form with only 0. 2–0. 3 weight % of chlorine.

Example 2

In this example the solid crystalline zirconium monochloride is obtained directly in the electrolytic cell. For that the process is conducted in the following manner: at first, electrolyzing a melt of about 20–25% LiCl, 24–28% KCl and 50–53% $SrCl_2$ (wt. ) containing 2. 5–3. 5% zirconium tetrachloride, using a comminuted zirconium metal anode consisting of basket as in example 1 with a powder of metal α-zirconium. The cell is the same as in example 1. The temperature is about 1300° F. Current density on the cathode is about 200 amperes per square foot. After several runs (one run consists of passing about 1000 coulombs and stopping the current for 10–15 min. ), the cathode deposit which is at first granular, becomes flaky. The process continues until all α-zirconium transgresses from the anode to the cathode and the deposit becomes flaky. After that, temperature is decreased to 750° F. , and the process is continued with current density about 150 amperes per square foot. The duration of the second stage of the process usually has to be about 3 times longer than the first stage. As a result the same new allotropic modification of metal zirconium is obtained.

Example 3

In this example the solid crystalline zirconium monochloride is obtained directly in the electrolytic cell by a simple chemical reaction between metal zirconium and zirconium tetrachloride dissolved in the melt. In this embodiment, the process is conducted in the following manner: first a powder or thin borings of metal α-zirconium is placed in an annular, nickel mesh basket, of which has dimensions that prevent easy passage of the initial zirconium particles and allows for formation of the zirconium monochloride without clogging. This basket serves as cathode and then placed along with a graphite anode in the electrolytic cell. The process is started in the melt of 20–25% LiCl, 24–28% KCl and 50–53% $SrCl_2$ (wt. ) containing 2. 5–3. 5 % zirconium tetrachloride at temperature about 1500° F. without passing electrical current through the electrolytical cell. $ZrCl_4$ is periodically added to the melt to support its concentration of about 2–3 weight %. After all metal zirconium in the basket is converted to zirconium monochloride the temperature is decreased to 750° F. , the cathode and anode are connected with the electrical poles and the process is continued as in example 2.

The preceding examples can be repeated with similar success by substituting the generally or specifically described melted electrolyte consisting of alkali or alkali earth metal chlorides or their complexes with chlorides of zirconium, or operating conditions of the process and components of the apparatus of this invention for those used in the preceding examples.

From the foregoing description, one skilled in the art can easily ascertain the essential characteristics of this invention and, without departing from the spirit and scope thereof; can make various changes and modifications of the invention to adapt it to various usages and conditions.

CRYSTAL STRUCTURE

The following table shows the results of X-ray powder analysis of a typical sample of the obtained new polymorphic modification of metal zirconium compared to α-zirconium and initial zirconium monochloride. These measurements clearly show that the structure of obtained metal is different from α-zirconium, and it is characterized by doubled planes of zirconium atoms with decreased to about 10% interatomic distances between atoms in doubled layers and increased to about 20% interatomic distances between zirconium atoms in neighboring doubled layers over α-zirconium made by the iodide process. A crystal structure of the obtained metal is presented in FIG. 1, *b*. For comparison, graphite which has a similar structure shows for 110 planes, 1. 42 A, and a distance between atoms in adjusted basal planes as 3. 35 A, compared to 3. 38 A in the allotropic modification of metal zirconium of my invention. These structural characteristics of the metal zirconium characterize it as a new polymorphic modification of transition metals with properties which defer significantly from metals in their close packed forms (for example α-zirconium, obtained by the iodide process and presented in FIG. 1, *c*). A density of the new polymorphic modification of metal zirconium with layered structure is 5. 1 g/cm$^3$ in comparison with 6. 49 g/cm$^3$ of α-zirconium made by the iodide process.

TABLE

| Zirconium monochloride | | α-zirconium | | Zirconium of present invention | |
|---|---|---|---|---|---|
| Inter-planar Spacing, A | Intensity | Inter-planar Spacing, A | Intensity | Inter-planar Spacing, A | Intensity |
| 2.80 | 3 | 8.92 | 10 | 3.76 | 3 |
| 2.573 | 3 | 4.45 | 5 | 3.54 | 1 |
| 2.459 | 10 | 2.96 | 4 | 3.11 | 10 |
| 1.894 | 2 | 2.706 | 3 | 2.25 | 7 |
| 1.616 | 2 | 2.218 | 8 | 1.15 | 6 |
| 1.463 | 2 | 1.878 | 1 | 1.93 | 1 |
| 1.368 | 2 | 1.78 | 4 | 1.88 | 4 |
| 1.35 | 1 | 1.709 | 6 | 1.77 | 3 |
| 1.287 | 1 | 1.682 | 3 | 1.555 | 2 |
| 1.23 | 1 | 1.592 | 1 | 1.416 | 7 |
| | | 1.481 | 1 | 1.368 | 7 |
| | | 1.452 | 3 | 1.316 | 3 |
| | | 1.354 | 7 | 1.259 | 4 |
| | | 1.270 | 3 | 1.250 | 3 |
| | | 1.232 | 4 | 1.241 | 2 |
| | | 1.214 | 2 | 1.081 | 3 |
| | | 1.121 | 3 | 1.078 | 2 |
| | | 1.106 | 2 | 1.062 | 2 |
| | | 1.061 | 2 | | |
| | | 1.02 | 4 | | |
| | | 0.99 | 4 | | |
| | | 0.933 | 4 | | |
| | | 0.903 | 5 | | |
| | | 0.856 | 6 | | |

What is claimed is:

1. The method of producing a composition of matter that is a new allotropic modification of metal zirconium or hafnium with layered structure consisting of double layers of close-packed metal atoms separated from another double layer by larger distances in which the ineratomic distance in the double layers of said allotropic modification of metal zirconium or hafnium is decreased about 10%, and the interatomic distance between double layers is increased about 20% in comparison with interatomic distances in the usual close-packed hexagonal from of the α-allotropic form of zirconium or hafnium, comprising removing halogen atoms from solid crystalline zirconium or hafnium monhalides by a reduction process without disturbing the metal atoms sublattice of said zirconium or hafnium monochlorides and monobromides.

2. The method as in claim 1 wherein further characterized by said reduction processes is an electrolysis process carried out in molten inorganic electrolyte consisting of lithium chloride and at least one of chlorides of other alkali or alkaline earth metals, at a temperature about 830° F. with the solid crystalline zirconium or hafnium monochloride or monobromide placed in a cathodic basket from an electroconductive material stable in said electrolyte where the electroconductive material is selected from the group consisting of nickel, molybdenum, and stainless steel and an anode from an electroconductive material stable in said electrolyte where the electroconductive material is selected from the group consisting of nickel, molybdenum, stainless steel or graphite; the current density on the cathode being about 200 amperes per square foot, producing the said layered polymorphic modification of metal zirconium or hafnium from solid crystalline zirconium monochloride or monobromide in the flake form; cooling said flakes in an inert atmosphere, and separating the adhering salts of said electrolyte from the flakes.

3. The method as in claim 2 further comprising starting the process of electrolysis wherein the at least one of the chlorides of other alkali or alkaline earth metals contains about 3% ZrCl4 dissolved in the said electrolyte melt and proceeding to carry out the electrolysis with a cathode from an electroconductive material stable in said electrolyte where the electroconductive material is selected from the group consisting of nickel, molybdenum, and stainless steel or graphite and comminuted zirconium or hafnium anode at temperature about 1300° F. with current density on the cathode being about 200 amperes per square foot, passing about 1000 coulombs and stopping the current for 10–15 minutes until the granular cathode deposit becomes flaky, decreasing the temperature to about 830° F. , to change the zirconium or hafnium anode to an anode of an electroconductive material stable in said electrolyte where the electroconductive material is selected from the group consisting of nickel, molybdenum, and stainless steel or graphite and continuing the electrolysis.

4. The method according to claim 3 wherein further characterized by using an anode from an electroconductive material stable in said electrolyte comprising nickel, molybdenum, stainless steel or graphite surrounded with metal zirconium or hafnium in their α-form in an annular basket from an inert metal stable in said electrolyte comprising nickel, molybdenum, or stainless steel with electrical contact between said metal zirconium or hafnium and said anode in an electrolytic cell and caring out the process as in claim 3 until all metal zirconium or hafnium transgresses from the anode to the cathode and the deposit becomes flaky, after that the temperature is decreased to about 850° F. , then the process is continued as in claim 3.

5. The method according to claim 2 wherein further characterized by placing a powder or bearings of the metal zirconium or hafnium in their α-form in an annular basket from an inert metal surrounding an cathode from electroconductive material stable in said electrolyte comprising nickel, molybdenum, or stainless steel with electrical contact between said cathode and metal zirconium or hafnium in molten inorganic electrolyte consisting of lithium chloride and at least one of the chlorides of other alkali or alkaline earth metals contain about 3% $ZrCl_4$ dissolved in the said electrolyte melt at temperature about 1500° F. with periodical addition of zirconium tetrachloride; using anode from electroconductive material stable in said electrolyte comprising nickel, molybdenum, stainless steel or graphite in an electrolytic cell and starting the process without passing an electrical current through the electrolytic cell until all metal zirconium or hafnium surrounding the cathode converts to zirconium or hafnium monochloride; then temperature is decreased to 750° F. , the anode and the cathode are connected with electrical poles and the process is continued as in claim 2.

* * * * *